US011221116B1

(12) United States Patent
Barber et al.

(10) Patent No.: US 11,221,116 B1
(45) Date of Patent: Jan. 11, 2022

(54) POST CAP SOLAR LIGHTING FIXTURE WITH BASE HAVING A PLURALITY OF DIAMETERS

(71) Applicant: PlayPower, Inc., Huntersville, NC (US)

(72) Inventors: Jeffrey B. Barber, Thurmont, MD (US); John Blake Hobson, Newark, OH (US); Michael L. Parody, Uxbridge, MA (US); D. Taft Egan, Draper, UT (US); Philip M. Erdley, Mifflinburg, PA (US); Steve Karchner, Mifflinburg, PA (US)

(73) Assignee: PLAYPOWER, INC., Huntersville, NC (US)

( * ) Notice: Subject to any disclaimer, the term of this patent is extended or adjusted under 35 U.S.C. 154(b) by 0 days.

(21) Appl. No.: 17/084,054

(22) Filed: Oct. 29, 2020

(51) Int. Cl.

| | |
|---|---|
| ***F21S 9/03*** | (2006.01) |
| ***F21V 3/02*** | (2006.01) |
| ***F21V 23/04*** | (2006.01) |
| *F21Y 115/10* | (2016.01) |

(52) U.S. Cl.
CPC ..... *F21S 9/037* (2013.01); *F21V 3/02* (2013.01); *F21V 23/0464* (2013.01); *F21Y 2115/10* (2016.08)

(58) Field of Classification Search
CPC .. F21S 9/03; F21S 9/037; F21V 15/01; F21V 7/0066; F21Y 2115/10; F16L 55/1283; F16L 55/1286; B65D 2251/08; B65D 2251/09
See application file for complete search history.

(56) References Cited

U.S. PATENT DOCUMENTS

| | | | | |
|---|---|---|---|---|
| 1,294,255 | A * | 2/1919 | Garretson | F16L 25/14 285/148.23 |
| 3,606,074 | A * | 9/1971 | Hayes | B65D 25/24 220/212 |
| 3,807,457 | A * | 4/1974 | Logsdon | F16L 55/1141 138/89 |
| 4,779,904 | A * | 10/1988 | Rich | F16L 25/14 277/355 |
| 5,123,627 | A | 6/1992 | Hodges | |
| 5,152,601 | A * | 10/1992 | Ferng | F21S 9/037 136/291 |
| 5,630,660 | A * | 5/1997 | Chen | B60Q 7/00 362/183 |
| 6,402,337 | B1 | 6/2002 | LeVasseur et al. | |
| 6,467,506 | B1 * | 10/2002 | Nguyen | F16L 25/14 116/276 |
| 6,585,398 | B1 * | 7/2003 | Haddad | F21V 13/12 362/328 |

(Continued)

OTHER PUBLICATIONS

Home Depot website capture for "Silver Chainlink Summit Solar Post Cap LED Post Cap (2-Pack)", captured Sep. 3, 2020.

(Continued)

*Primary Examiner* — Ismael Negron
(74) *Attorney, Agent, or Firm* — Sandberg Phoenix & von Gontard P.C.

(57) ABSTRACT

The light fixture includes a bottom end having multiple stepped diameters dimensioned to fit in different posts; an outwardly curved transparent top cover; a solar panel positioned below the top cover; a central reflector provided below the solar panel; and a plurality of light elements arranged around the reflector.

19 Claims, 10 Drawing Sheets

(56) References Cited

U.S. PATENT DOCUMENTS

| | | | | |
|---|---|---|---|---|
| 7,172,307 | B2 * | 2/2007 | Izardel | F21S 9/037 362/153.1 |
| 8,684,554 | B2 * | 4/2014 | Jensen | F21S 9/032 362/183 |
| 8,858,015 | B2 * | 10/2014 | Harshaw | G09F 13/02 362/183 |
| 9,591,843 | B2 * | 3/2017 | Formico | F21K 9/00 |
| 9,951,940 | B2 * | 4/2018 | Hui | F21V 31/00 |
| 10,323,369 | B2 * | 6/2019 | Bahiri | F21S 8/032 |
| 10,443,768 | B1 * | 10/2019 | McConnell | F16L 25/14 |
| 10,704,780 | B1 * | 7/2020 | Ko | F21V 23/04 |
| 10,724,695 | B2 * | 7/2020 | Tang | F21V 23/04 |
| 2004/0111902 | A1 | 6/2004 | Fletcher | |
| 2005/0213316 | A1 * | 9/2005 | Inman | F21V 5/04 362/152 |
| 2008/0080174 | A1 * | 4/2008 | Xu | F21S 8/081 362/152 |

OTHER PUBLICATIONS

Home Depot website capture for "Bollard Lights", captured Sep. 8, 2020.
First Light Technologies website capture for "Award Winning Solar Bollards", captured Sep. 8, 2020.
AccessFixtures.com website capture for "Playground Lighting", captured Sep. 8, 2020.
McMaster-Carr.com website capture for "Bollard Caps", captured Sep. 8, 2020.

* cited by examiner

POST CAP SOLAR LIGHTING FIXTURE WITH BASE HAVING A PLURALITY OF DIAMETERS

BACKGROUND

The present disclosure relates to a light fixture which can be retrofitted to existing commercial structures to add lighting. It is particularly contemplated that such light fixtures are used as playground post caps.

Most American schools and parks possess some sort of playground. The local public playground is commonly used as long and late into the night as possible. Lighting a public playground can extend the play time hours, and also reduce vandalism and other undesirable activities.

BRIEF DESCRIPTION

Disclosed in the present disclosure are light fixtures which are intended to be used to add lighting to commercial playground structures. They are designed to create lighting in the playground equipment to maximize visibility. This promotes extended use time and minimizes the opportunity for vandalism. The light fixtures use a solar charging LED system that requires no electrical service and that operates within a completely enclosed housing. No trenching or wiring costs are incurred during installation. The lighting is directed downwards, minimizing light pollution and neighborhood complaints.

Disclosed in various embodiments are LED light fixtures, comprising: a top cap with an outwardly curving upper surface; a solar panel underneath the top cap; a central reflector underneath the solar panel; a set of LEDs arranged around an outer perimeter of the central reflector; and a bottom cap; wherein the top cap and the bottom cap engage each other to form at least three stages having stepped diameters.

The at least three stages may include a first stage, at least one intermediate stage, and a final stage. The first stage may have a diameter from about 4 inches to about 7 inches. The first stage may have a height from about 1 inch to about 3 inches. The at least one intermediate stage may have a diameter from about 3.5 inches to about 5 inches. The at least one intermediate stage may have a height from about 0.5 inches to about 1.5 inches. The final stage may have a diameter from about 2 inches to about 3.5 inches. The final stage may have a height from about 1 inch to about 3 inches.

In specific embodiments, the at least three stages include a first stage, a second stage, a third stage, and a final stage.

In some particular embodiments, the first stage has a diameter from about 4 inches to about 7 inches and a height from about 1 inch to about 3 inches; the second stage has a diameter from about 4 inches to about 5 inches and a height from about 0.5 inches to about 1.5 inches; the third stage has a diameter from about 3.5 inches to about 4 inches and a height from about 0.5 inches to about 1.5 inches; and the fourth stage has a diameter from about 2 inches to about 3.5 inches and a height from about 1 inch to about 3 inches.

In more specific embodiments, the first stage has a diameter of about 5.5 inches and a height of about 2 inches; the second stage has a diameter of about 4.7 inches and a height of about 0.9 inches; the third stage has a diameter of about 3.7 inches and a height of about 0.9 inches; and the fourth stage has a diameter of about 3.2 inches and a height of about 1.4 inches.

The solar panel may be adjacent a top side of a printed circuit board, and the set of LEDs may be on a bottom side of the printed circuit board. The outwardly curving upper surface of the top cap may have a radius of curvature from about 12 inches to about 14 inches. The top cap may be transparent.

The central reflector may include an annular bottom surface.

The top cap and the bottom cap may form a housing, and an entire interior volume of the housing may be sealed off from the ambient environment. A bottom surface of the bottom cap may be annular, such that an interior volume of the central reflector is accessible. The bottom cap may include a set of pillars that support the central reflector. A top end of the central reflector may include a lip for attaching the central reflector to a printed circuit board.

The walls forming the top cap may have a constant thickness. The walls forming the bottom cap may have a constant thickness.

The LED light fixture may further comprise a photocell for automatically turning the set of LEDs on and off. The LED light fixture may further comprise an on-off switch that permits the LEDs to be turned on. The LED light fixture may further comprise at least one battery located within the central reflector.

In some embodiments, the at least three stages include a first stage, at least one intermediate stage, and a final stage; and wherein the first stage, the at least one intermediate stage and the final stage all have the same cross-sectional shape.

In other embodiments, the at least three stages include a first stage, at least one intermediate stage, and a final stage; and wherein the at least one intermediate stage and the final stage all have the same cross-sectional shape, and the first stage may have a different cross-sectional shape from the at least one intermediate stage and the final stage.

Alternatively, the at least three stages may include a plurality of intermediate stages that alternate between two different cross-sectional shapes.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 9A is an illustration of the light fixture mounted on a post having a first diameter. Only a first stage of the light fixture is visible.

FIG. 9B is an illustration of the light fixture mounted on a post having a second diameter. Only the first stage and the second stage of the light fixture are visible.

FIG. 9C is an illustration of the light fixture mounted on a post having a first diameter. The first, second, and third stages of the light fixture are visible.

DETAILED DESCRIPTION

Figure 1:
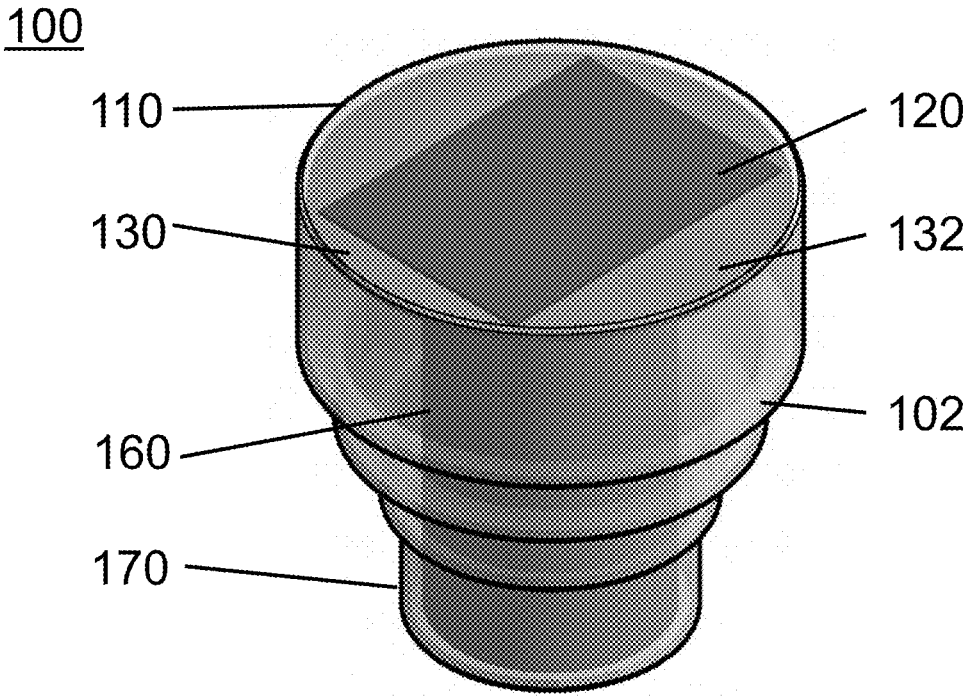
FIG. 1 is a top perspective view of a first embodiment of the light fixture of the present disclosure.

A more complete understanding of the components and devices disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

The term "comprising" is used herein as requiring the presence of the named components/steps and allowing the presence of other components/steps. The term "comprising" should be construed to include the term "consisting of", which allows the presence of only the named components/steps.

Numerical values should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

The terms "top" or "upper" and "bottom" or "lower" are used to refer to locations/surfaces where the top/upper is always higher than the bottom/lower relative to an absolute reference, i.e. the surface of the earth. The terms "upwards" and "downwards" are also relative to an absolute reference; upwards is always against the gravity of the earth.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other.

The present disclosure includes structures which are described herein with respect to a circular/cylindrical shape, but which can have any regular polygonal cross-sectional shape, such as square, pentagonal, hexagonal, etc. The term "diameter" is used to refer to the line segment having the greatest length that passes through the center of the cross-sectional shape and perpendicularly to the vertical axis of the structure. For example, the term "diameter" would refer to the diameter of a circular cross-sectional shape, and also refer to the diagonal of a square cross-sectional shape. Similarly, the term "annulus" or "annular" refers to the shape formed between two concentric shapes having different diameters.

The present disclosure relates to light fixtures which are intended to be used to add lighting to commercial playground structures. The light fixtures can be used as post caps on the vertical support posts or equipment support posts that support the play structure. The light fixtures can also be used as caps on other fence posts, posts, tubes, or bollards that may be present at a playground. The light fixture uses light-emitting diodes (LEDs). A solar panel is provided to charge a battery which powers the LEDs.

FIG. 1 is a top perspective view of a first embodiment of the light fixture 100, which is based on a cylindrical/circular shape. The light fixture includes a rectangular solar panel 120 visible through a transparent top cap 110. The solar panel 120 is placed adjacent a top side 132 of an opaque printed circuit board 130, to which it is wired. The transparent top cap 110 engages a transparent bottom cap 170, and together they form a transparent housing or shell 102 for the components within the light fixture. A central reflector 160 is visible through the transparent housing. The top cap, bottom cap, and central reflector are concentric about a central vertical axis.

Figure 2:
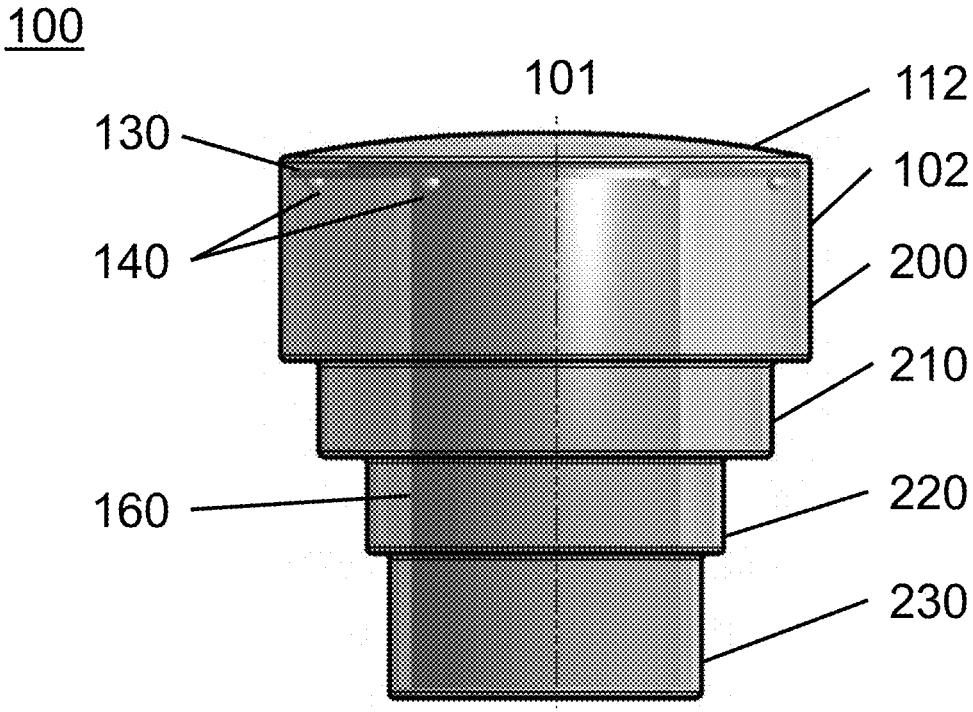
FIG. 2 is a first side view of the light fixture of FIG. 1.

FIG. 2 is a first side view of the light fixture 100. The central vertical axis is indicated with reference numeral 101. A plurality of LEDs 140 are visible through the transparent housing, arranged around the outer perimeter of the central reflector 160. The LEDs are wired to the printed circuit board. Comparing FIG. 1 to FIG. 2, it should be noted that the opaque printed circuit board 130 is present between the solar panel 120 of FIG. 1 and the LEDs 140 of FIG. 2. This directs the light downward to the area immediately under the light fixture.

Continuing with FIG. 2, it can be seen that the upper surface 112 of the top cap curves outwardly, or is a convex surface. The outward curve of the upper surface 112 prevents accumulation of standing water (e.g. from rain). The outward curve of the upper surface also increases the difficulty of resting any object upon the upper surface (e.g. preventing a child from standing on the upper surface).

The exterior surface of the housing 102 also includes a set of stages, each stage having a different diameter. Thus, the housing could also be described as forming a set of stepped diameters. The set of stepped diameters has at least three stages: a first stage, at least one intermediate stage, and a final stage. Here, the light fixture 100 is illustrated as having four stages, a first stage 200, a second stage 210, a third stage 220, and a final stage 230. The second stage and the third stage are intermediate stages. Any number of intermediate stages can be present, and the present disclosure should not be limited to permitting or requiring only two intermediate stages. The stages are arranged in order by decreasing diameter, with the largest diameter being near the top of the housing and the smallest diameter being at the bottom of the housing. The first stage has the largest diameter of all stages, and the final stage has the smallest diameter of all stages.

Figure 3:
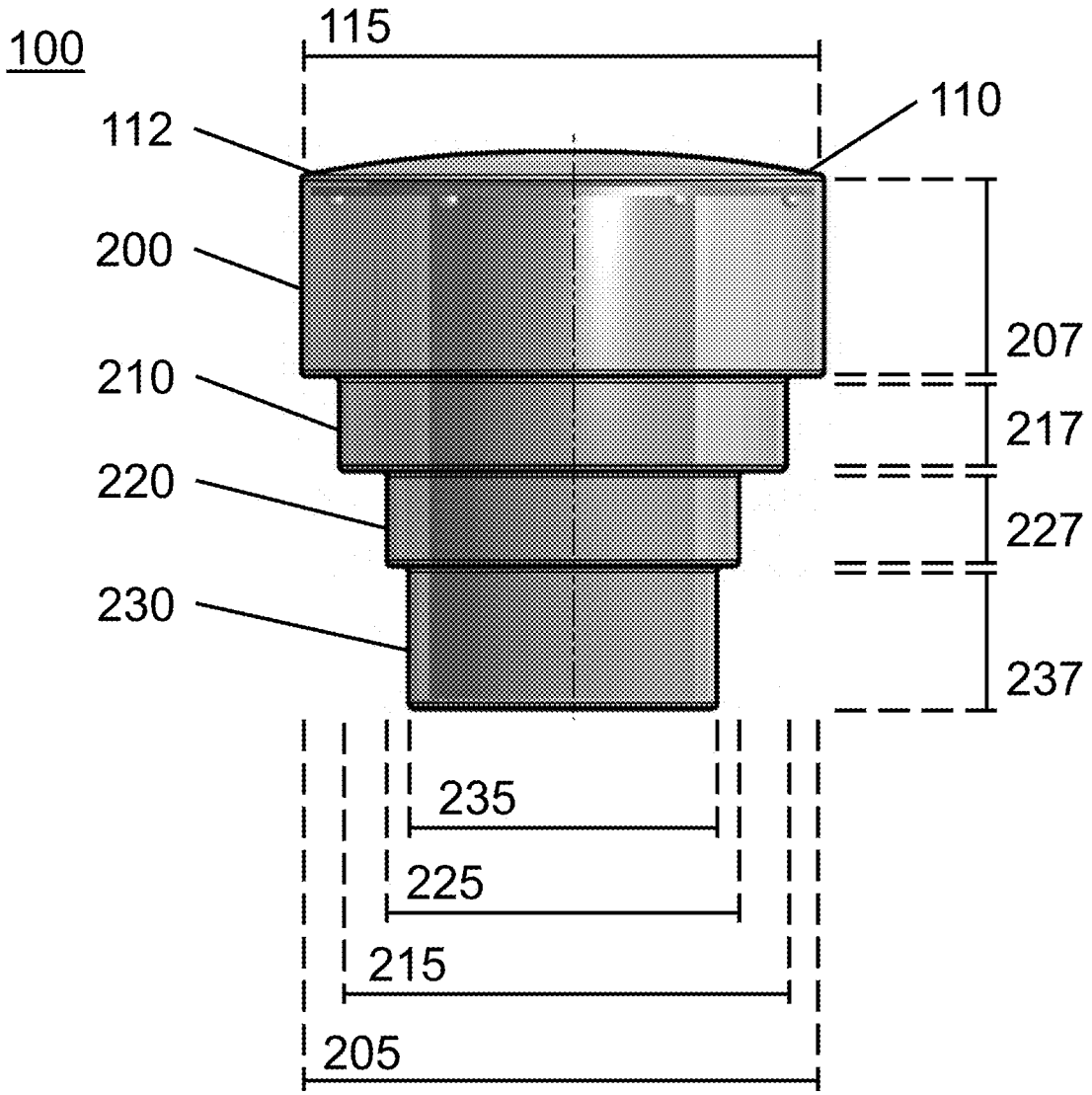
FIG. 3 is a second side view of the light fixture of FIG. 1.

FIG. 3 is a second side view of the light fixture 100. The first stage 200 has a first stage diameter 205 and a first stage height 207. The second stage 210 has a second stage diameter 215 and a second stage height 217. The third stage 220 has a third stage diameter 225 and a third stage height 227. The final stage 230 has a final stage diameter 235 and a final stage height 237.

As seen in FIG. 3, the first stage diameter 205 is the largest diameter of the stepped diameters. Similarly, the final stage diameter 235 is the smallest diameter of the stepped diameters. The final stage diameter 235 is less than the third stage diameter 225, which is less than the second stage diameter 215, which is less than the first stage diameter 205.

Generally, the first stage may have a diameter from about 4 inches to about 7 inches. The at least one intermediate stage may have a diameter from about 3.5 inches to about 5 inches. The final stage may have a diameter from about 2 inches to about 3.5 inches.

In particular embodiments, the first stage diameter 205 is from about 4 inches to about 7 inches, including from about 5 inches to about 6 inches, or about 5.5 inches.

In particular embodiments, the second stage diameter 215 is from about 4 inches to about 5 inches, including about 4.7 inches.

In particular embodiments, the third stage diameter 225 is from about 3.5 inches to about 4 inches, including about 3.7 inches.

In particular embodiments, the final stage diameter 235 is from about 2 inches to about 3.5 inches, including about 3.2 inches.

It should be noted that the diameter 115 of the top cap is the same as the first stage diameter 205, or put another way the top cap does not create a ledge over the entire light fixture. Also, in particular embodiments, the top cap 110 has a radius of curvature of from about 12 inches to about 14 inches, including about 13 inches.

Continuing, as illustrated in FIG. 3, the first stage height 207 is the greatest height. It should be noted the first stage height 207 does not include the additional height created by the curve of the upper surface 112. The final stage height 237 is the second greatest height. The intermediate stages can have the same height, or can have different heights, as desired.

Generally, the first stage may have a height from about 1 inch to about 3 inches. The at least one intermediate stage may have a height from about 0.5 inches to about 1.5 inches. The final stage may have a height from about 1 inch to about 3 inches.

In particular embodiments, the first stage height 207 is from about 1 inch to about 3 inches, including about 2.0 inches.

In particular embodiments, the second stage height 217 is from about 0.5 inches to about 1.5 inches, including about 0.9 inches.

In particular embodiments, the third stage height 227 is from about 0.5 inches to about 1.5 inches, including about 0.9 inches.

In particular embodiments, the final stage height 237 is from about 1 inch to about 3 inches, including about 1.4 inches.

Any combination of diameter and height is contemplated for each stage as described above, and any combination of stages with a diameter and height is contemplated.

Figure 4:
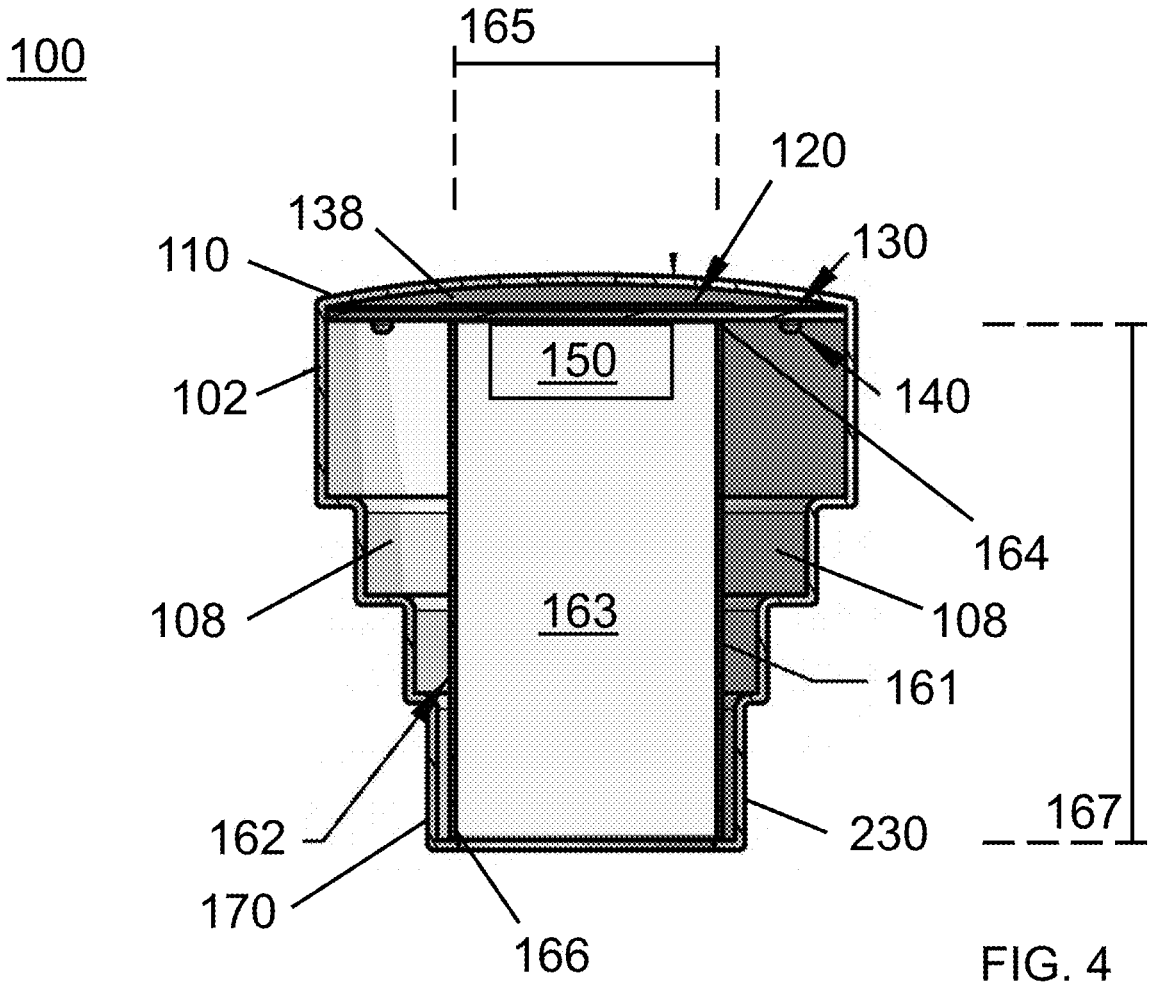
FIG. 4 is a side cross-sectional view of the light fixture of FIG. 1.

FIG. 4 is a side cross-sectional view of the light fixture 100 of FIG. 1. In this embodiment, the central reflector includes a cylindrical sidewall 161 with a reflective exterior surface 162. The top end 164 of the central reflector is proximate the printed circuit board 130, and the bottom end 166 is proximate the final stage 230. The central reflector surrounds or includes an interior volume 163, within which the battery 150 is located. The battery is also wired to the printed circuit board, to provide power to the LEDs 140.

The central reflector has a diameter 165 and a height 167. Comparing FIG. 3 to FIG. 4, the diameter 165 of the central reflector is less than the final stage diameter 235, such that the central reflector fits within the portion of the housing that makes up the final stage. The height 167 of the central reflector is about equal to the sum of the height 207 of the first stage, the height 237 of the final stage, and the heights 217, 227 of the intermediate stages.

Referring now to FIG. 4 again, it should be noted that the walls making up the top cap 110, the bottom cap 170, and the housing 102 formed therefrom are shown as having a generally constant thickness. The different diameters of the various stages are generally due to the shape of the top cap and the bottom cap, not due to changing thicknesses of their walls. However, the thicknesses of the walls could also be changed, though this is generally not desired for economic reasons. The volume 108 between the housing and the central reflector may contain air, some inert gas, or even vacuum, as desired. The open volume between the top cap 110 and the solar panel 120 and the printed circuit board 130 (if any) is indicated with reference numeral 138.

As illustrated in FIG. 4, the bottom end 166 of the central reflector is closed off by the bottom cap 170, or in other words the interior volume 163 is sealed by the housing formed from the top cap 110 and the bottom cap 170. In addition, the entire interior volume of the housing (volumes 108, 138, and 163) is sealed off from the ambient environment.

Figure 5:
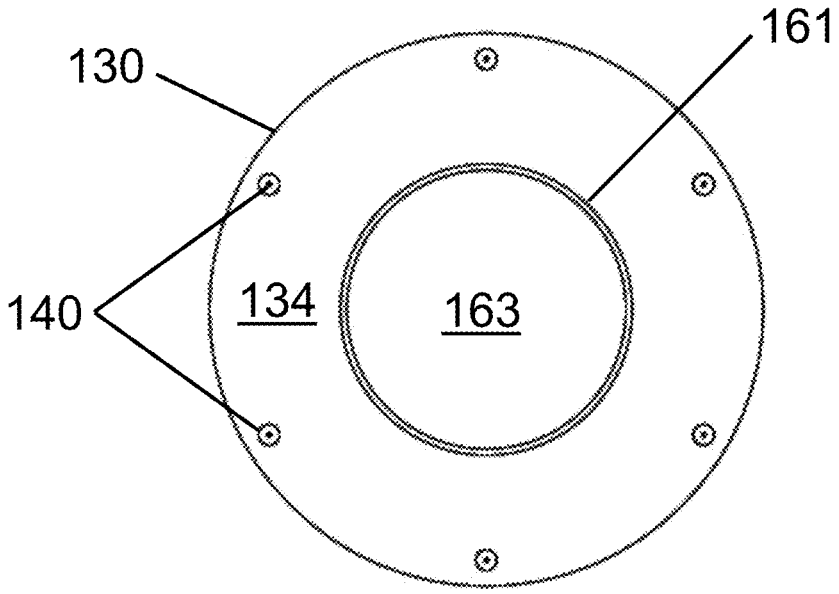
FIG. 5 is a bottom view showing the printed circuit board and the central reflector. The housing formed from the top cap and the bottom cap is removed.

FIG. 5 is a bottom view showing the bottom side 134 of the printed circuit board and the sidewall 161 of the central reflector. As seen here, when viewed along the central vertical axis, both the printed circuit board and the central reflector have a circular cross-section shape. The LEDs 140 are generally arranged around an outer perimeter or circumference of the central reflector sidewall (i.e. not within the internal volume 163), or around the perimeter of the printed circuit board 130. The LEDs are also generally spaced evenly apart from each other. The number of LEDs is not particularly significant. In particular embodiments, there are at least four LEDs, such as six or eight LEDs, and there may be up to 12 LEDs.

Figure 6:
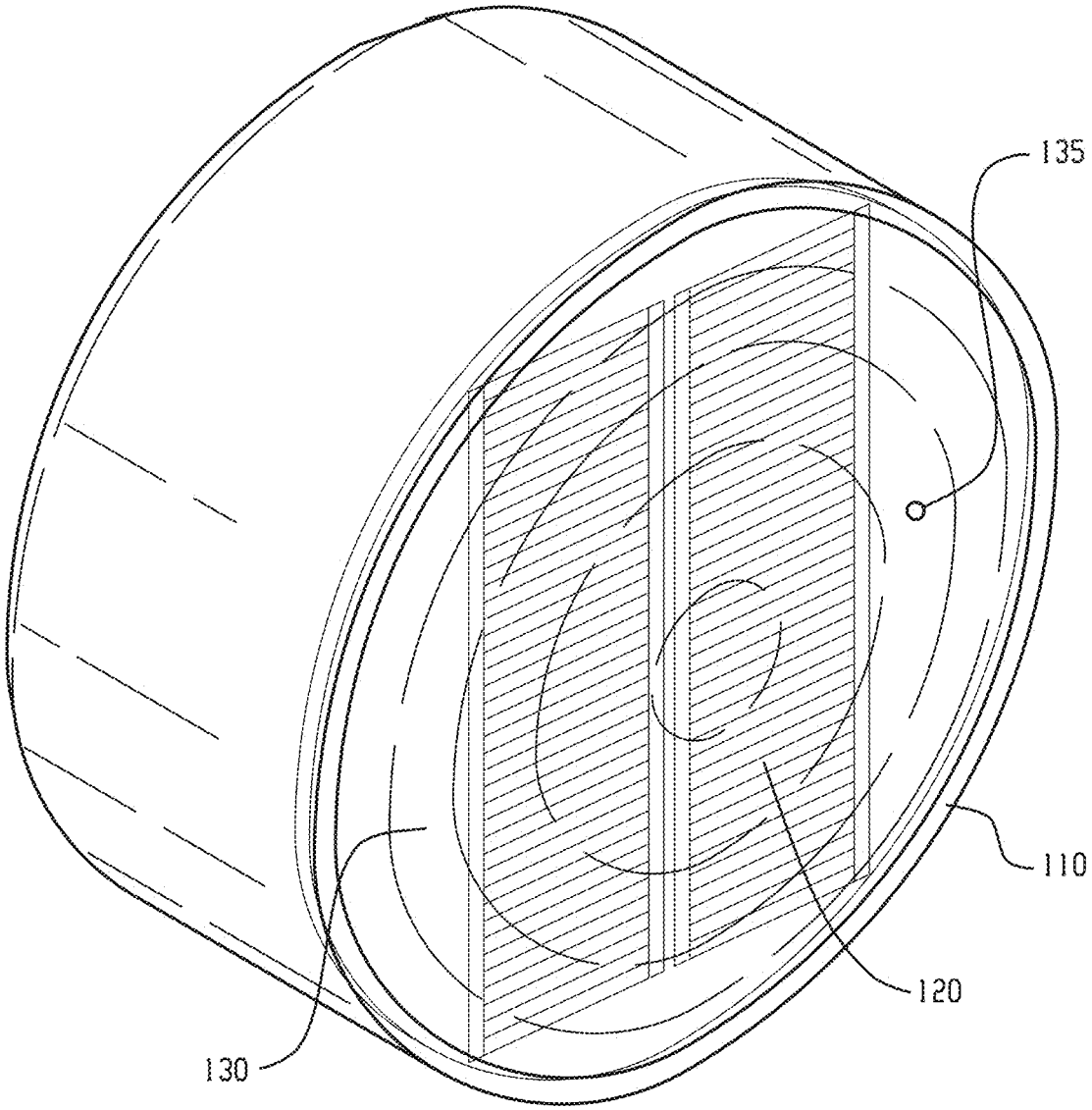
FIG. 6 is a top perspective view of a light fixture.
Figure 7:
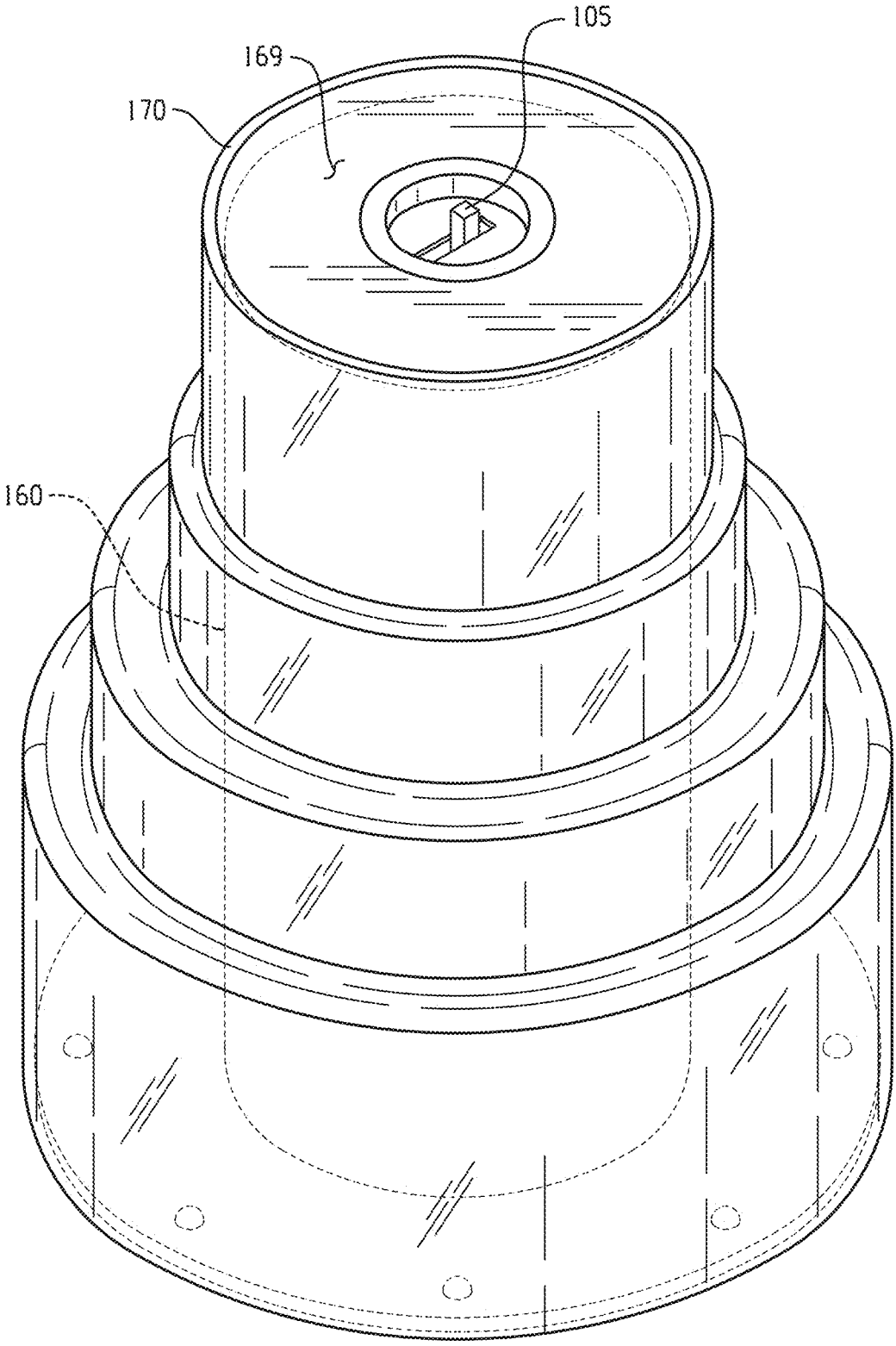
FIG. 7 is a bottom perspective view of the light fixture of FIG. 6.
Figure 8:
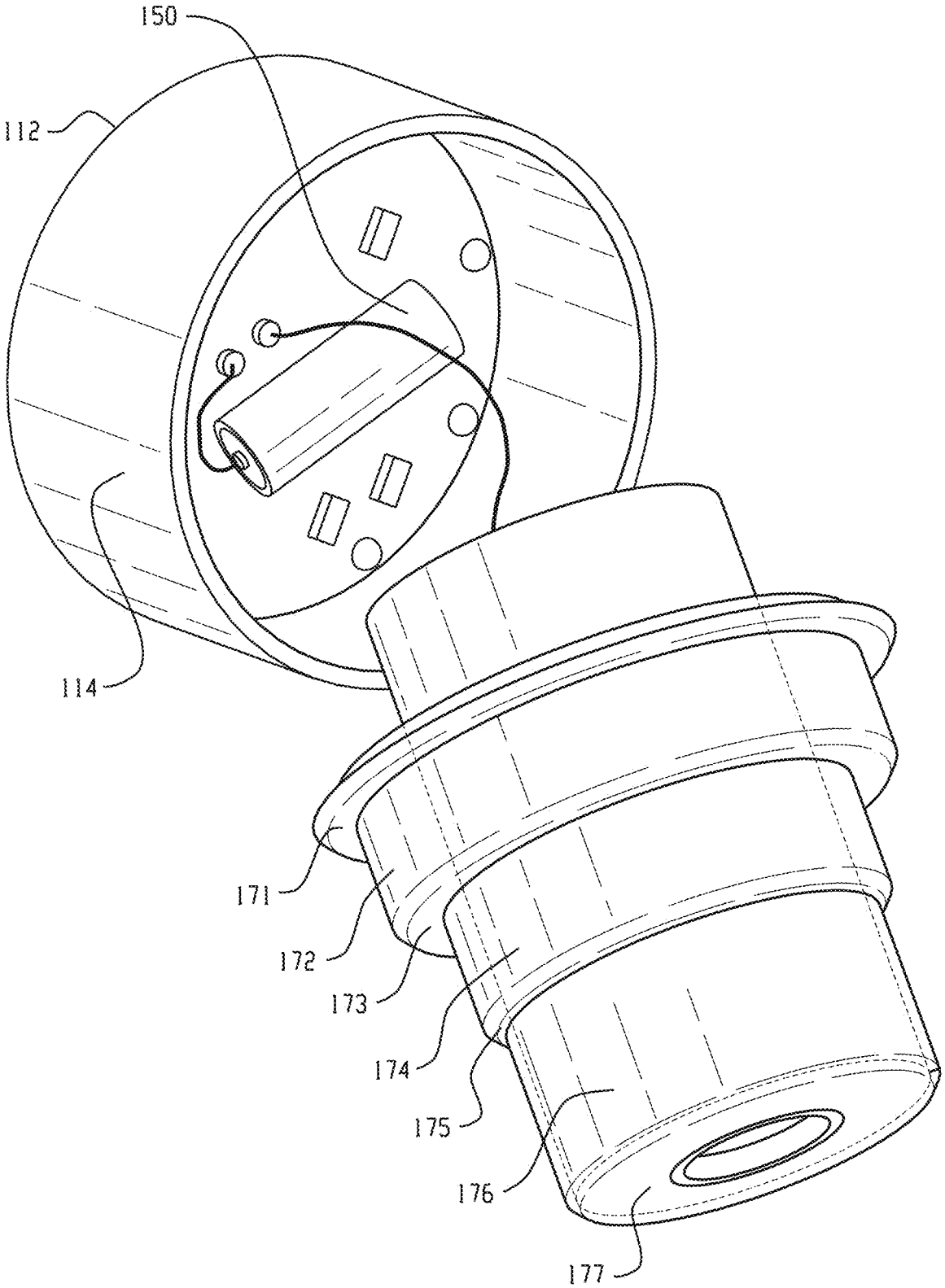
FIG. 8 shows some internal components of the light fixture of FIG. 6.

FIGS. 6-8 are various views of one embodiment of the light fixture 100. FIG. 6 is a top perspective view. FIG. 7 is a bottom perspective view. FIG. 8 shows some internal components of the light fixture.

In the top perspective view of FIG. 6, the solar panel 120 is visible. The printed circuit board 130 is glued or press-fitted to the top cap 110, or other suitable means can be used. The top side of the printed circuit board also includes a photocell 135 (marked for emphasis), which will be used as explained further below.

As seen in the bottom perspective view of FIG. 7, the central reflector also includes a bottom surface 169, which is in the form of an annulus. In this particular embodiment, an optional on-off switch 105 is present in the center of the bottom surface, and the switch extends through the bottom cap 170. When present, the on-off switch is glued in place, or can be fastened by any other known means. The central reflector can be attached to the bottom cap 170 by any desired means, such as by glue or by press-fit. The bottom end of the central reflector is completely closed off by the bottom cap 170, or in other words the interior volume within the central reflector is fully enclosed by the housing and is not accessible from the exterior.

When present, the on-off switch 105 is used to permit the LEDs to be turned on, or to positively turn the LEDs off. In use, when the on-off switch 105 is in the "on" position, the photocell of FIG. 6 is used to determine whether ambient light is sufficient or whether the LEDs should be turned on. The photocell can include, for example, a photoresistor (e.g. a CdS cell). When light shines on a CdS cell, the resistance decreases. The printed circuit board includes a detector circuit which turns on the LEDs when the resistance reaches a specified threshold level. High resistance means that there is no light shining on the photocell, so the LEDs are turned on. Photodetectors could also be used. A photodetector converts light into current, and the LEDs can be turned on when the current reaches a specified threshold level. The on-off switch does not need to be present, and can be eliminated. In those embodiments without an on-off switch, the photocell would determine whether the LEDs are turned on or off.

Referring now to FIG. 8, the battery 150 is seen, along with wires leading to the on-off switch. The top cap is formed from the upper surface 112 and a vertical sidewall 114 that forms part of the first stage of the housing. The bottom cap can be described as a single body having four horizontal sidewalls 171, 173, 175, 177 and three vertical sidewalls 172, 174, 176. Each stage of the housing is formed from one horizontal sidewall and one vertical sidewall. The top cap and the bottom cap can be joined together by glue, or shaped so as to be screwed together or with a tongue-and-groove joint, by fasteners, or other known means.

The top cap and the bottom cap are made from a transparent impact-resistant material, such as acrylonitrile-butadiene-styrene (ABS), polycarbonate, acrylic, or other transparent polymers. It is noted that the top cap and the bottom cap can each provide any number of sidewalls to form the stages of the overall housing. The present disclosure should not be construed as limiting the top cap to providing only one sidewall.

The central reflector is reflective, to reflect light away from the interior of the housing and outwards. This can be done using, for example, a reflective metal such as aluminum or silver, or by making a mirror, or by applying a reflective material to a cylindrical support[ ].

The resulting light fixture 100 has multiple stepped diameters at its bottom end. These different diameters permit the light fixture to be attached or inserted into posts of different diameters. This is illustrated in FIGS. 9A-9C.

Figure 9A:
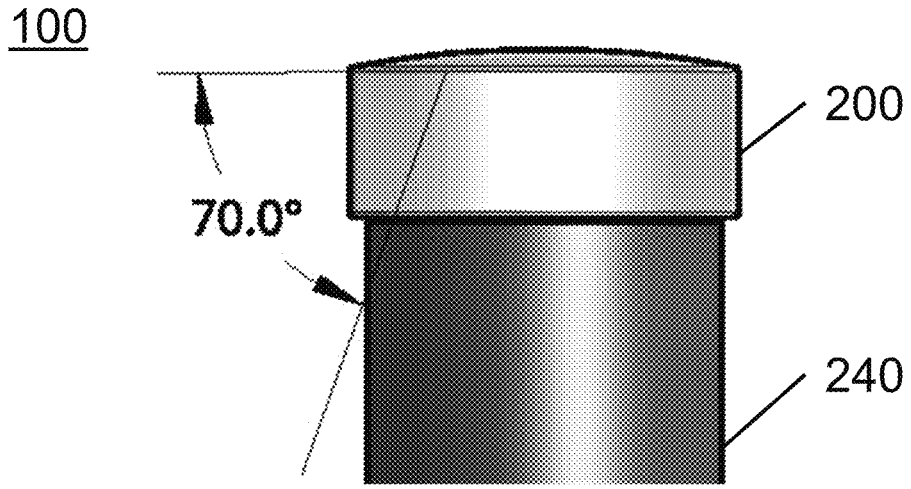
FIGS. 9A-9C illustrate the same light fixture being attached or inserted into posts of different diameters.

In FIG. 9A, the light fixture 100 is inserted into a post 240 that has a relatively large diameter, greater than that of the second stage diameter but less than that of the first stage diameter. As a result, only the first stage 200 is visible. As illustrated here, the light projects downwards up to 70° relative to the plane of the printed circuit board.

Figure 9B:
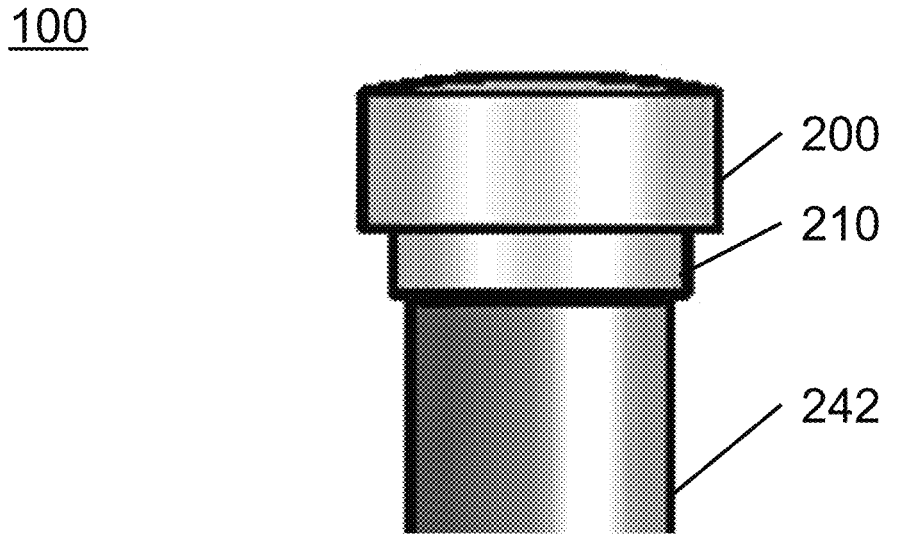

In FIG. 9B, the light fixture 100 is inserted into a post 242 that has a diameter greater than that of the third stage diameter but less than that of the second stage diameter. As a result, the first stage 200 and the second stage 210 are visible.

Figure 9C:
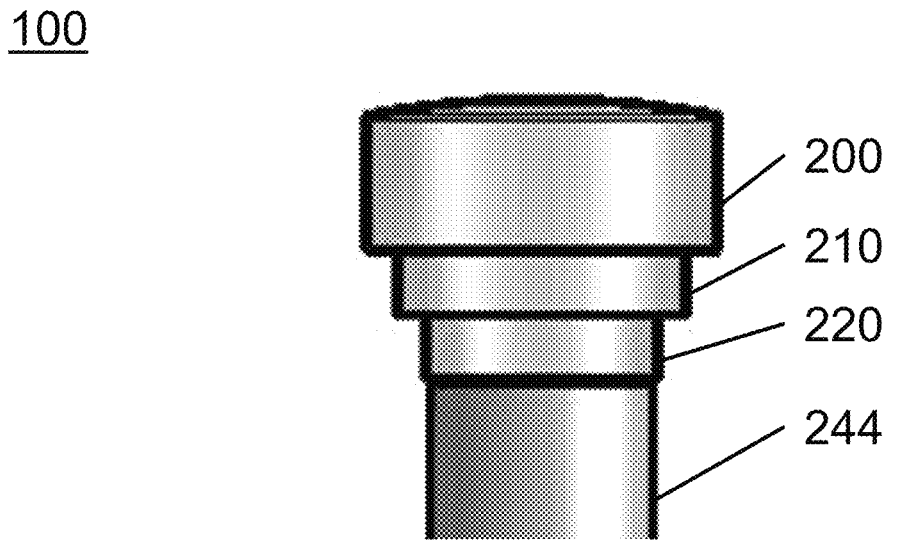

Finally, in FIG. 9C, the light fixture 100 is inserted into a post 244 that has a diameter greater than that of the final stage diameter but less than that of the third stage diameter. As a result, the first stage 200, the second stage 210, and the third stage 220 are visible.

It is noted that in FIGS. 9A-9C, the final stage is always located within the post 240, 242, 244, and is thus not visible. Thus, the portions of the housing that make up the final stage do not need to be transparent for light to pass through. However, the portions of the housing that make up the first stage 200 and any intermediate stages are transparent. The light fixture can be joined to the post by glue, fastener, or other fastening means as desired.

It is also noted that these figures illustrate the post and the light fixture as having a circular cross-sectional shape along their central vertical axis. However, the present disclosure is applicable to other shapes, such as a square cross-sectional shape. In particular, it is specifically contemplated that in some embodiments, the first stage, the intermediate stage(s), and the final stage all have the same cross-sectional shape along their central vertical axis. It is also contemplated that in some embodiments, the intermediate stage(s) and the final stage all have the same cross-sectional shape, but the first stage has a different cross-sectional shape from the intermediate stage(s) and the final stage. It is also contemplated that multiple intermediate stages might be present which alternate between two different cross-sectional shapes.

Figure 10A:
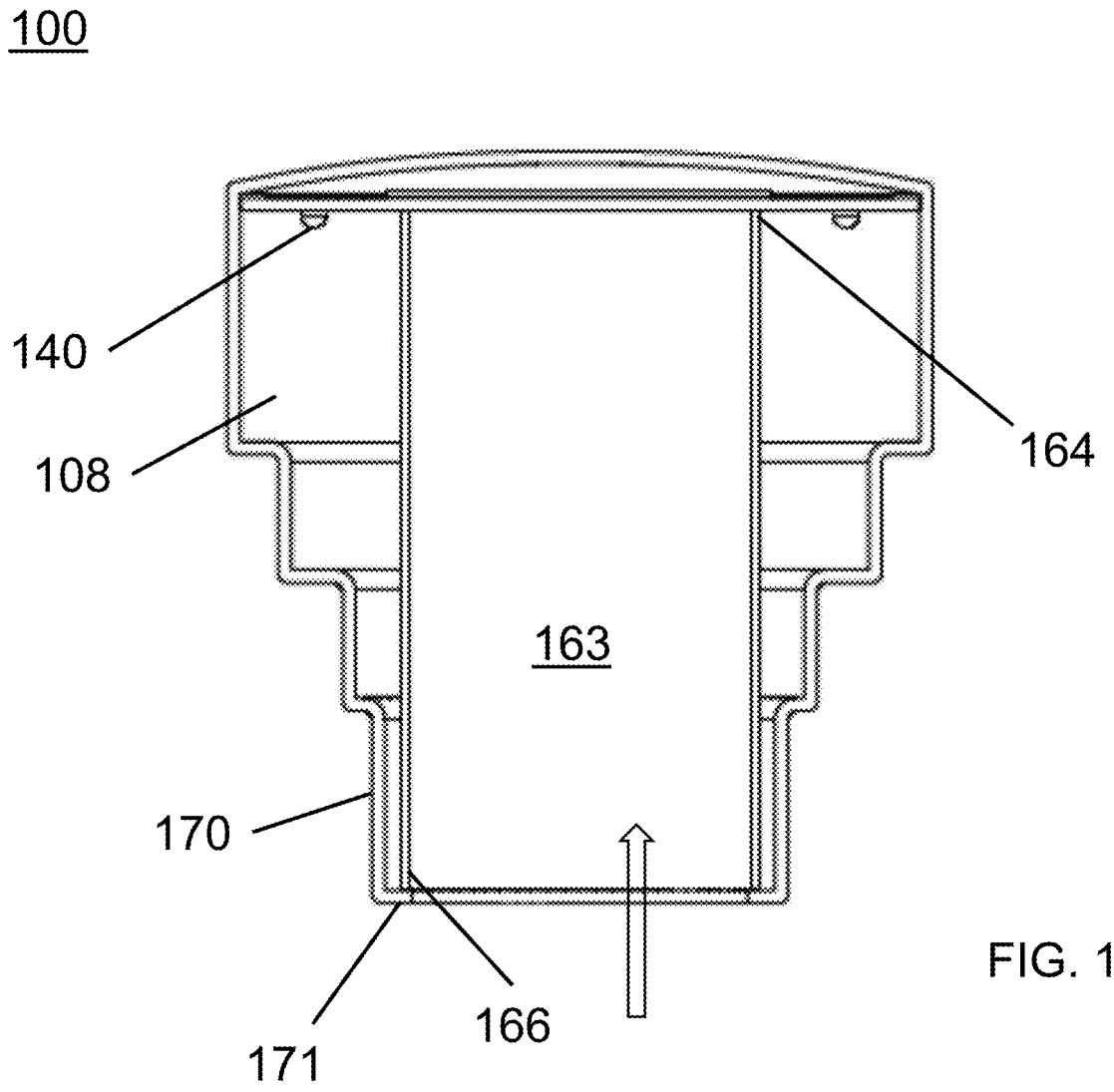
FIG. 10A is a side cross-sectional view showing some variations of the light fixture of the present disclosure.
Figure 10B:
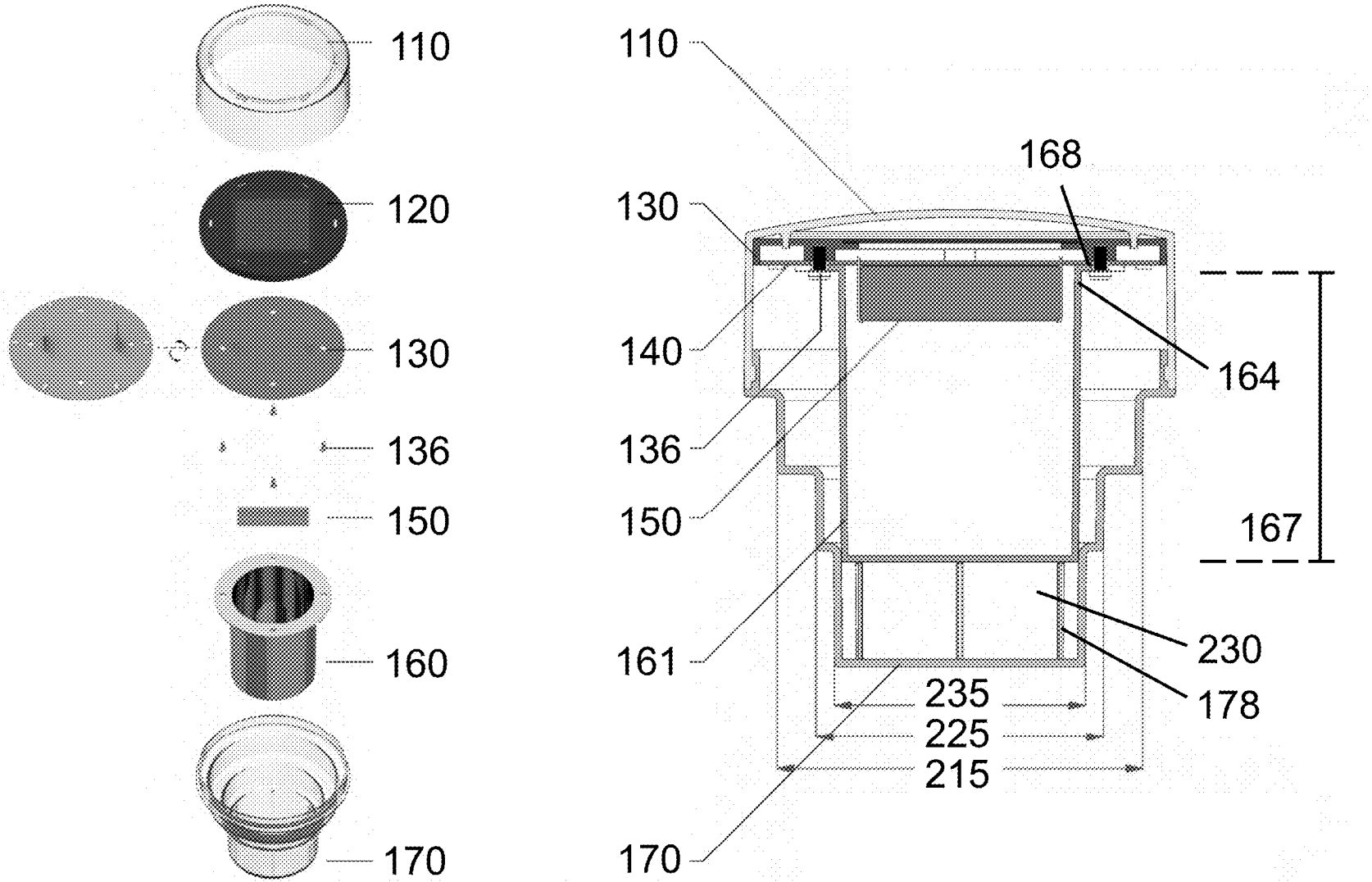
FIG. 10B is a side cross-sectional view showing other variations of the light fixture of the present disclosure. An exploded view of the light fixture is also provided.

FIG. 10A and FIG. 10B illustrate some variations on the light fixture that are contemplated. These two figures are side cross-sectional views.

The light fixture 100 illustrated in FIG. 10A varies from that of FIG. 4 in that the bottom surface 171 of the bottom cap is annular, rather than a complete surface. As a result, the bottom end 166 of the central reflector is not closed off by the bottom cap 170, and so the interior volume 163 is still accessible from the exterior (as indicated by the arrow). This may be desirable, for example, to be able to access and replace the battery. It is noted that the LEDs 140 in volume 108 can still be sealed off from the ambient environment at the top end 164 and the bottom end 166 of the central reflector.

In the variation of FIG. 10B, the height 167 of the central reflector is reduced compared to that of FIG. 4. As previously noted, the final stage 230 is always located within the post. Thus, in FIG. 10B, the bottom cap 170 includes pillars 178 within the final stage 230. The sidewall 161 of the central reflector rests on top of these pillars, such that the top end 164 of the central reflector still abuts the printed circuit board 130. The central reflector thus extends through only the first stage, the second stage, and the third stage, where its light reflection function is used. As previously mentioned, the portion of the housing making up final stage 230 might be opaque, since light transmission through final stage 230 is not essential. Of course, the top cap 110 is transparent so light can reach the solar panel.

In addition, the top end 164 of the central reflector includes a lip 168. The central reflector is then attached to the printed circuit board 130 via screws 136 that engage the lip 168. The LEDs 140 are illustrated as being closer to the perimeter of the printed circuit board 130 than the screws 136 are.

The diameters 215, 225, 235 of the stages making up the bottom cap 170 are also indicated.

FIG. 10B also includes an exploded view showing the various components of the light fixture: top cap 110, solar panel 120, printed circuit board 130, screws 136, battery 150, central reflector 160, and bottom cap 170.

Figure 11:
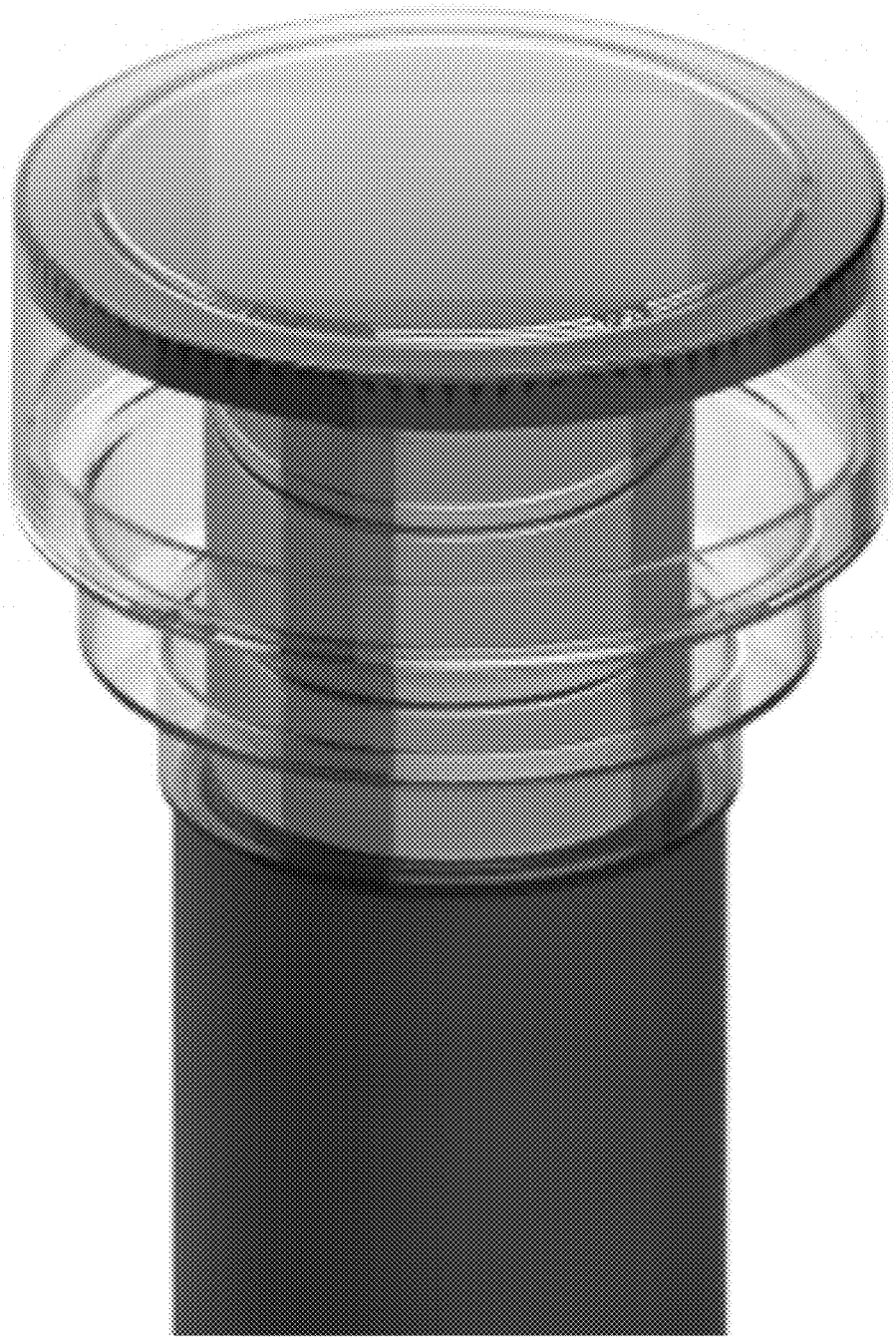
FIG. 11 is a picture with a top perspective view of the light fixture installed on a post.

FIG. 11 is a picture with a top perspective view of the light fixture installed on a post, with the first stage, second stage, and third stage visible.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A light fixture, comprising:

a top cap and a bottom cap which in combination define a housing; said housing defining:

a top stage comprising an upper surface and a top stage side surface; said side surface defining a top stage diameter; said top stage side surface being light transmissive;

at least one intermediate stage below said top stage and defining a diameter less than said top stage diameter; said at least one intermediate stage having an intermediate stage side surface, said intermediate stage side surface being light transmissive;

a final stage below said at least one intermediate stage; said final stage comprising a final stage side surface and defining a final stage diameter less than the diameter of said at least one intermediate stage; and a central reflector extending through at least said top stage and said at least one intermediate stage; and a set of light elements arranged around an outer perimeter of the central reflector;

wherein said at least one intermediate stage and final stage are adapted to be received in posts of different diameters and wherein light from said light elements, when activated, will illuminate all exposed side surfaces of said light fixture.

2. The light fixture of claim 1, wherein said at least one intermediate stage defines a first intermediate stage diameter and a second intermediate stage diameter; said first intermediate stage diameter being less than said diameter of said top stage, said second intermediate stage diameter being less than said first intermediate stage diameter, and said diameter of said final stage being less than said second intermediate stage diameter.

3. The light fixture of claim 1, further including a printed circuit board proximate an upper end of said first stage side wall and a solar panel adjacent a top side of a printed circuit board, wherein the set of light elements is below the printed circuit board.

4. The light fixture of claim 1, wherein the top stage is transparent.

5. The light fixture of claim 1, wherein the housing defines a volume; the entire interior volume of the housing being sealed off from the ambient environment.

6. The light fixture of claim 1, wherein the central reflector includes an annular bottom surface; or wherein a bottom surface of the bottom cap is annular, such that an interior volume of the central reflector is accessible.

7. The light fixture of claim 1, wherein the bottom cap includes a set of pillars that support the central reflector, such that a bottom of the central reflector is spaced above a bottom of the final stage.

8. The light fixture of claim 1, wherein the walls forming the top cap have a constant thickness; or wherein the walls forming the bottom cap have a constant thickness.

9. The light fixture of claim 1, further comprising:

(A) a photocell for automatically turning the set of light elements on and off; or (B) an on-off switch that permits the light elements to be turned on; or (C) at least one battery located within the central reflector.

10. The light fixture of claim 1, wherein:

(i) the top stage, the at least one intermediate stage and the final stage all have the same cross-sectional shape; or (ii) the at least one intermediate stage and the final stage all have the same cross-sectional shape, and the top stage has a different cross-sectional shape from the at least one intermediate stage and the final stage; or (iii) the at least one intermediate stage includes a plurality of intermediate stages that alternate between two different cross-sectional shapes.

11. The light fixture of claim 1 wherein said bottom cap comprises an upper portion and a lower portion; said upper portion comprising said at least one intermediate stage and said lower portion comprising said final stage.

12. The light fixture of claim 1 further including a printed circuit board, wherein a top end of the central reflector includes a lip for attaching the central reflector to the printed circuit board.

13. The light fixture of claim 1 wherein said top cap comprises said top stage.

14. The light fixture of claim 13 wherein said upper surface defines a diameter substantially equal to the diameter of said side surface of said top stage.

15. The light fixture of claim 1 wherein the set of light elements are positioned in the top stage.

16. The light fixture of claim 15 wherein the set of light elements are positioned proximate an upper end of the top stage.

17. The light fixture of claim 1 wherein the upper surface of said top stage defines a slope.

18. The light fixture of claim 17, wherein the upper surface of the top cap defines an outwardly curving surface.

19. The light fixture of claim 18 wherein the outwardly curving upper surface of the top cap has a radius of curvature from about 12 inches to about 14 inches.

* * * * *